United States Patent [19]

Nakagoshi et al.

[11] Patent Number: 4,923,692

[45] Date of Patent: May 8, 1990

[54] PROCESS FOR PRODUCING PITCH-TYPE CARBON FIBERS

[75] Inventors: Akira Nakagoshi; Hiroshi Tahara; Tetuo Yamada, all of Kitakyushu; Hiroyuki Sekiguchi; Hidemi Murata, both of Sakaide, all of Japan

[73] Assignee: Mitsubishi Kasei Corporation, Tokyo, Japan

[21] Appl. No.: 253,402

[22] Filed: Oct. 3, 1988

Related U.S. Application Data

[63] Continuation of Ser. No. 60,517, Jun. 11, 1987, abandoned.

[30] Foreign Application Priority Data

| | | | |
|---|---|---|---|
| Jun. 12, 1986 | [JP] | Japan | 61-137180 |
| Jun. 19, 1986 | [JP] | Japan | 61-143441 |
| Jul. 1, 1986 | [JP] | Japan | 61-154586 |
| Jul. 8, 1986 | [JP] | Japan | 61-160338 |
| Jul. 14, 1986 | [JP] | Japan | 61-165237 |

[51] Int. Cl.[5] ..... D01F 9/12

[52] U.S. Cl. ..... 423/447.4; 423/447.1; 423/447.2; 423/447.6; 264/29.2

[58] Field of Search ..... 423/447.1, 447.2, 447.4, 423/447.6; 264/29.2

[56] References Cited

U.S. PATENT DOCUMENTS

| | | | |
|---|---|---|---|
| 3,552,922 | 1/1971 | Ishikawa et al. | 423/447.4 |
| 4,582,662 | 4/1986 | Koga et al. | 423/447.6 |
| 4,656,022 | 4/1987 | Uemura et al. | 423/447.4 |

FOREIGN PATENT DOCUMENTS

| | | | |
|---|---|---|---|
| 175200 | 3/1986 | European Pat. Off. | 264/29.2 |
| 59-199872 | 11/1984 | Japan | 264/29.2 |
| 60-88124 | 5/1985 | Japan | 264/29.2 |

OTHER PUBLICATIONS

European Search Report No. EP 87 10 8397 dated 04-07-1989.

*Primary Examiner*—John Doll
*Assistant Examiner*—Robert M. Kunemund
*Attorney, Agent, or Firm*—Oblon, Spivak, McClelland, Maier & Neustadt

[57] ABSTRACT

A process for producing pitch-type carbon fibers, which comprises melt-spinning pitch material in a gaseous atmosphere to form pitch fibers, gathering the pitch fibers in the presence of an oiling agent into a tow, followed by infusible treatment, carbonization treatment and, if necessary, graphitization treatment, of the tow of pitch fibers, characterized in that the tow of pitch fibers is brought in contact with a washing liquid to wash the surface of the pitch fibers prior to the infusible treatment.

31 Claims, 3 Drawing Sheets

PROCESS FOR PRODUCING PITCH-TYPE CARBON FIBERS

Figure 1:
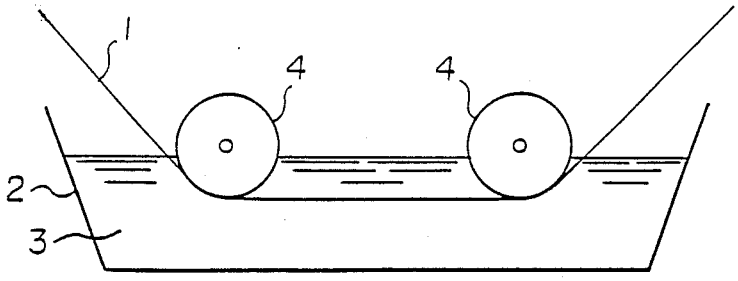

This application is a continuation of application Ser. No. 060,517, filed June 11, 1987, now abandoned.

The present invention relates to a process for producing carbon fibers from pitch material such as a coal-originated pitch, a petroleum pitch or a baked polymer pitch. More particularly, it relates to a process for producing carbon fibers of high quality without fusion or adhesion of fibers to one another, whereby the handling of the fibers can be easy and doubling of fiber tows can be easily conducted.

Pitch-type carbon fibers are produced usually by melt-spinning the pitch material to form pitch fibers and subjecting the pitch fibers to infusible treatment and carbonization treatment. Such pitch-type carbon fibers have an advantage that they can be produced in good yield and industrially advantageously as compared with carbon fibers made of e.g. polyacrylonitriles. On the other hand, they have a disadvantage that the pitch fibers are extremely brittle and difficult to handle for the treatments for the production of pitch-type carbon fibers. When an external force higher than the fiber strength is exerted to such brittle pitch fibers, they are likely to undergo fluffing, breakage, tangling or twining round guide rollers, and it has been necessary to pay careful attentions.

As a method for solving the above difficulty, it is common to employ a method wherein a lubricant is applied to pitch fibers and a plurality of such fibers are gathered to form a tow of pitch fibers. As the lubricant for such gathering, a silicone-type lubricant, a higher alcohol-type lubricant or a higher fatty acid-type lubricant is employed. Further, there is a method wherein a lubricant containing fine solid particles is applied to the surface of fibers.

As one of applications wherein pitch-type carbon fibers are used as a reinforcing material, it is required that from 100 to 1,000 fiber monofilaments are gathered to form a tow, and from 10 to 1,000 such tows are doubled, and if necessary, twisted to form a thick fiber bundle. For the production of such a thick fiber bundle, it has been common that the doubling of fiber tows is conducted by using carbon fibers having adequate fiber strength, since pitch fibers are extremely brittle as mentioned above.

The above-mentioned conventional method in which brittle pitch fibers are used in the form of a fiber tow which is easier to handle, has an advantage that the fluffing, twining round guide rollers or breakage of fibers can be prevented. On the other hand, it has drawbacks such that due to the thermal decomposition or property change of the lubricant during the heat treatment such as infusible treatment or carbonization treatment, adhesion or fusion of fibers to one another is likely to take place. In the case where a lubricant containing fine solid particles is employed, adverse effects to the strength and elongation of fibers are likely to be brought about during the baking such as carbonization treatment or graphitization treatment, although it is effective to prevent the adhesion or fusion during the infusible treatment.

Further, in the case of the conventional method wherein fibers are doubled in the form of carbon fibers to obtain a desired thick fiber bundle, a great deal of infusible fibers as precursor fibers are required and accordingly, a great deal of tows of pitch fibers are required, whereby the size of the apparatus for the baking process is required to be large, and the production costs are high accordingly.

On the other hand, in the case where pitch fibers are doubled, it is required to control the winding up speed and tensile force to minimize the effect of the mechanical contact of the fibers with rollers or guides, since the pitch fibers themselves are extremely brittle and difficult to handle. Therefore, it has been difficult to practice the process with sufficient productivity. On the other hand, if it is attempted to simply double pitch fibers, even when the problems such as fluffing or breakage of fibers can be avoided by careful handling, when a carbon fiber bundle after the baking treatment of tows of such pitch fibers, is subjected to fibrillation treatment, it will be disbundled into the initial individual fiber tows, and thus there is a problem in the bundling of the doubled fiber tows.

Further, pitch fibers prior to the carbonization treatment are extremely brittle, and in the fibrillating treatment by means of rollers, there will be difficulties such that the pitch fibers undergo breakage or twining round rollers. On the other hand, if the fibrillating treatment is conducted in a gaseous phase, static electricity is likely to form among fiber monofilaments, whereby there has been a problem in the handling.

When the melt spinning of pitch fibers is conducted for a long time under stretching in a gaseous phase by means of a spinneret having at least 100 nozzles, it is likely that a few fiber monofilaments undergo breakage.

Once, breakage takes place, no stretching force is exerted to the broken fiber monofilaments, such monofilaments will be entrapped in the form of thick non-stretched filaments in the tow of pitch fibers, and eventually bundled together with such tows. The non-stretched fibers have a large diameter, and therefore the infusible treatment suitable for the stretched fibers will be inadequate for such non-stretched fibers. Consequently, in the subsequent carbonization treatment, they are likely to melt, thus leading to adhesion or fusion of the fibers around them, and thereby causing fluffing or breakage of fibers. Therefore, it used to be necessary that prior to the carbonization treatment, the tow of gathered fibers is fibrillated by means of e.g. rollers to completely remove the non-stretched fibers contained in the fiber tow.

The present inventors have conducted extensive researches to solve the above-mentioned problems, and as a result, have found it possible to solve the problems by washing the fiber surface with a washing liquid to remove an excess oiling agent and then conducting after-treatments such as infusible treatment and carbonization treatment. The present invention has been accomplished on the basis of this discovery.

The present invention provides a process for producing pitch-type carbon fibers, which comprises melt-spinning pitch material in a gaseous atmosphere to form pitch fibers, gathering the pitch fibers in the presence of an oiling agent into a tow, followed by infusible treatment, carbonization treatment and, if necessary, graphitization treatment, of the tow of pitch fibers, characterized in that the tow of pitch fibers is brought in contact with a washing liquid to wash the surface of the pitch fibers prior to the infusible treatment.

Another object of the present invention is to provide a process whereby the doubling operation of fiber tows, or gathering of fibers to form a fiber tow, can be efficiently conducted, and pitch-type carbon fibers of a high quality can constantly be produced. This object can be easily accomplished by a process for producing pitch-type carbon fibers, which comprises melt-spinning pitch material in a gaseous atmosphere to form pitch fibers, gathering the pitch fibers in the presence of an oiling agent into a tow, followed by infusible treatment, carbonization treatment and, if necessary, graphitization treatment, of the tow of pitch fibers, characterized in that the tow of gathered pitch fibers is introduced in the washing liquid in a direction substantially vertical to the surface of the liquid, then turned in the liquid to a direction substantially opposite to the direction of the introduction, and withdrawn from the liquid in the substantially opposite direction. Further, the object can also be accomplished by a process for producing pitch-type carbon fibers, which comprises melt-spinning pitch material in a gaseous atmosphere to form pitch fibers, gathering the pitch fibers in the presence of an oiling agent into a tow, followed by infusible treatment, carbonization treatment and, if necessary, graphitization treatment, of the tow of pitch fibers, characterized in that the tow of gathered pitch fibers is introduced into the washing liquid spread to form a laminar flow, and then withdrawn from the liquid.

A further object of the present invention is to remove non-stretched fibers contained in the tow of pitch fibers. This object can be accomplished by a process for producing pitch-type carbon fibers, which comprises melt-spinning pitch material in a gaseous atmosphere to form pitch fibers, gathering the pitch fibers in the presence of an oiling agent into a tow, followed by infusible treatment, carbonization treatment and, if necessary, graphitization treatment, of the tow of pitch fibers, characterized in that the tow of pitch fibers is fibrillated in the liquid into pitch fiber monofilaments constituting the tow so that non-stretched pitch fiber monofilaments contained in the tow are thereby removed.

A still further object of the present invention is to obtain carbon fibers of high quality, even when pitch fibers obtained by melt-spinning are required to be stored for a while. This object can be accomplished by a process for producing pitch-type carbon fibers, which comprises melt-spinning pitch material in a gaseous atmosphere to form pitch fibers, gathering the pitch fibers in the presence of an oiling agent into a tow, followed by infusible treatment, carbonization treatment and, if necessary, graphitization treatment, of the tow of pitch fibers, characterized in that the tow of pitch fibers in a wet condition is rapidly dried so that the amount of the deposited liquid is not more than 5% by weight, and then stored.

Now, the present invention will be described in detail with reference to the preferred embodiments.

In the accompanying drawings, FIGS. 1 to 4 illustrate different embodiments of the washing step of the process of the present invention.

Figure 5:
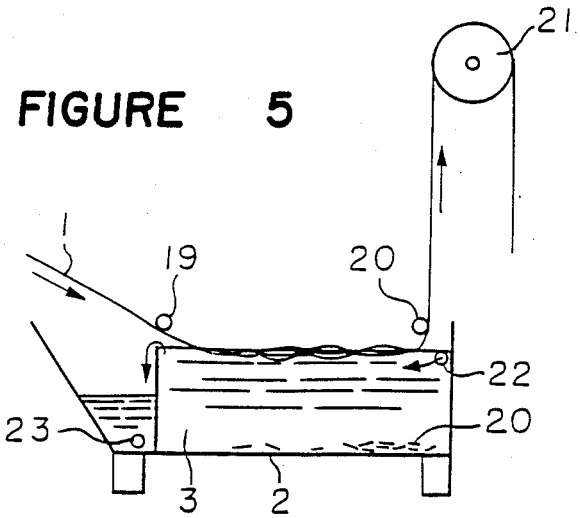

FIG. 5 illustrates the fibrillation step of the present invention.

As the pitch material to be used in the present invention, there may be mentioned a coal-originated pitch such as coal tar pitch or liquefied coal; a petroleum pitch such as a distillation residue obtained by the distillation of crude oil under atmospheric or reduced pressure or a heat-treated product thereof, or a heat-treated product of by-product tar obtained by the pyrolysis of naphtha; and a baked polymer pitch obtained by the carbonization of a synthetic of natural resin.

The melt spinning of the pitch material is conducted in the same manner as in the case of dry melt spinning of ordinary synthetic fibers, and there is no particular restriction as to the manner of the melt spinning. It is preferred to employ a method wherein the molten pitch material is extruded into a gaseous atmosphere from spinning nozzles directed downwardly, whereupon the extruded fibers are cooled and solidified. It is usual to employ spinning nozzles with discharge outlets having a diameter of from 0.1 to 0.5 mm. The temperature of the spinning nozzles is determined depending upon the type of the pitch material to provide a melt viscosity most suitable for spinning, and it is usually selected within a range of from 250° to 350° C. It is effective for the stabilization of spinning to provide temperature-keeping cylinders below the spinning nozzles.

As the oiling agent for pitch fibers, there may be employed, for instance, a silicone oil lubricant, a higher alcohol lubricant, a higher fatty acid lubricant or a mixture thereof, and an emulsion thereof. Specifically, the silicone oil includes dimethylpolysiloxane, phenylmethylpolysiloxane, epoxypolysiloxane and aminopolysiloxane; the higher alcohol includes stearyl alcohol, oleyl alcohol and isopentacosanyl alcohol; the higher fatty acid includes stearic acid glyceride, polyethylene glycol stearate, polyethylene glycol oleate; and fine solid particles include graphite, carbon black, silica or titanium oxide.

As the emulsifier to be used for the preparation of the emulsion, a nonionic emulsifier such as polyoxyethylene lauric acid, an anionic emulsifier such as an alkyl sulfate or a cation emulsifier such as chlorinated alkylpyridinium, may be mentioned.

To the oiling agent, an antistatic agent may be incorporated, as the case requires. As such an antistatic agent, there may be mentioned, for instance, an anionic agent such as an alkyl sulfate, a cationic agent such as a quaternary ammonium salt and an amphoteric agent such as betaine.

When the oiling agent is diluted for use, it is convenient to use, as a diluent, the washing liquid of the present invention which will be described hereinafter. The oiling agent is applied usually in an amount of from 0.1 to 100 parts by weight, preferably from 0.5 to 15 parts by weight, as the oiling agent proper i.e. excluding the diluent, relative to 100 parts by weight of the pitch fibers.

The washing liquid to wash the surface of the gathered pitch fibers may be any liquid so long as it does not substantially dissolve the pitch fibers and capable of being evaporated at the temperature for infusible treatment. For instance, it includes an aliphatic alcohol having from 1 to 4 carbon atoms such as methanol, ethanol, propanol, butanol, isopropanol, ethylene glycol or cellosolve; an alicyclic alcohol having from 3 to 6 carbon atoms such as cyclopentanol or cyclohexanol; a ketone having from 3 to 6 carbon atoms such as acetone, methyl ethyl ketone, methyl isobutyl ketone or cyclohexanone; and water. These liquids may be used alone or in combination in the form of a solution wherein they are mixed in optional proportions.

The washing liquid is properly selected depending upon the type of the pitch fibers to be washed and the particular purpose.

Figure 2:
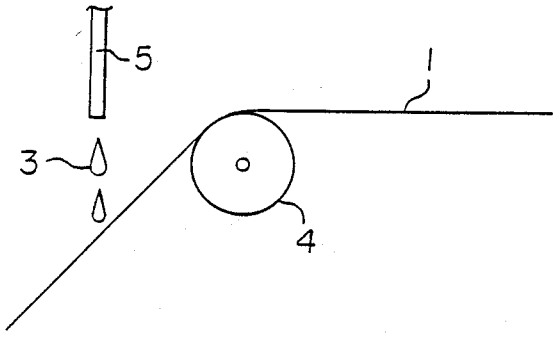

With such a washing liquid, the oiling agent deposited on the fibers is washed away so that the amount of the boiling agent remaining on the fibers will be not more than 5 parts by weight, preferably not more than 0.5 part by weight, as the oiling agent proper i.e. excluding the diluent, relative to 100 parts by weight of the fibers. The washing method includes a method of passing the fibers in the washing liquid, and a method of spraying or dropping the washing liquid to the fibers. For instance, there may be mentioned a method as illustrated in FIG. 1, wherein a tow 1 of pitch fibers is passed through a tank 2 filled with a washing liquid 3 by means of rollers 4, or a method as illustrated in FIG. 2, wherein a washing liquid 3 is directly dropped onto a tow 1 of pitch fibers.

Further, in the present invention, it is preferred to conduct the contact of the tow of pitch fibers with the washing liquid by introducing the tow of gathered pitch fibers into the liquid in a direction substantially vertical to the surface of the liquid, then turning it in the liquid to a direction substantially opposite to the direction of the introduction and withdrawing it from the liquid in the substantially opposite direction.

Now, an embodiment wherein water is used as the washing liquid, will be described. The specific gravity of pitch fibers is usually from 1.3 to 1.4 i.e. heavier than water. However, if the tow of pitch fibers is simply dipped in water, it is hardly immersed in water because of a substantial amount of fine air bubbles present in the bundled fibers and because of the poor wettability of pitch fibers since the pitch fibers are hydrophobic. Therefore, for the introduction of the tow of pitch fibers, it is preferred to introduce the tow in the direction substantially vertical to the water surface and to let the water flow.

In the present invention, it is preferred that during the transportation of the tow of pitch fibers in the liquid, the tensile force exerted during the transportation in the gaseous phase is eliminated or reduced so that no substantial tensile force is exerted to the fiber monofilaments constituting the tow during the transportation in the liquid.

Figure 3:
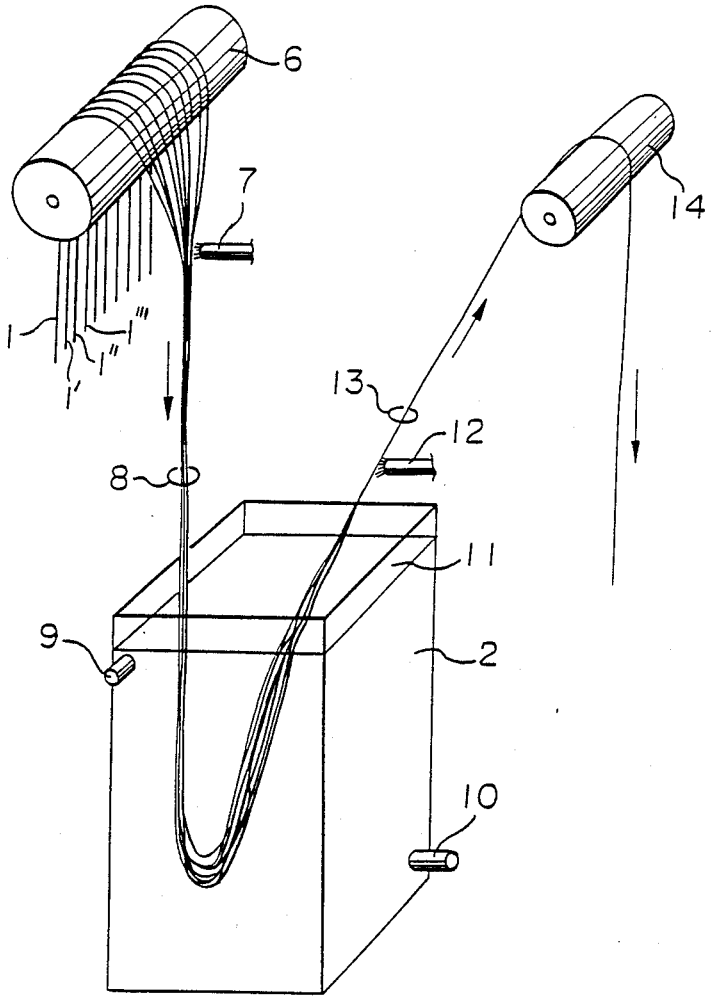

One of the embodiments of the present invention will be described in detail with reference to FIG. 3. In FIG. 3, water is supplied to a treating tank 2 from a conduit 10 so that water is always overflowing from a water outlet 9, whereby water is maintained at a constant level. A plurality of tows 1,1′,1″ . . . of pitch fibers are loosely doubled by the rotation of a roller 6, then subjected to a water stream supplied from a conduit 7, and pass through a ring 8 provided in the gaseous phase outside the treating tank 2. Then, they are introduced into water 11 of the treating tank 2 in a direction vertical to the water surface. The fiber tows introduced into water are immersed deep in water and turned in water to a direction opposite to the direction of introduction. During this process, the fiber tows are fibrillated in water into individual fiber monofilaments constituting the tows, and withdrawn through a ring 13 provided in the gaseous atmosphere outside the treating tank 7, by a roller 14. At that time, a uniform tensile force is exerted to fiber monofilaments whereby a bundle of fibers are aligned. The alignment of the bundle of fibers and the doubling treatment can more effectively be conducted by countercurrently contacting the withdrawn fiber tow with the water stream supplied from the conduit 12.

Further, when a liquid having a smaller surface tension than water and readily wetted to pitch fibers, specifically, the above-mentioned oiling agent such as an alcohol or ketone, is used, the introduction of the fiber tows in the liquid can be made with a certain oblique angle so long as it is still substantially vertical to the liquid surface.

The size of the treating tank is not restricted so long as it gives a sufficient space for liquid so that adequate fibrillation can be conducted while turning the direction of the transportation of the fiber tows in water. It is usual to employ a treating tank capable of maintaining a liquid with a liquid level of at least 30 mm, preferably from 40 to 1,000 mm in the tank.

The tow of fibers withdrawn from the treating tank has fiber filaments well aligned. There is no particular restriction as to the number of tows of pitch fibers to be treated by this embodiment. However, it is preferred to use a plurality of tows for the doubling operation. If necessary, the liquid contained in the withdrawn fiber tow is removed by drying by a conventional method, and then the tow is introduced to the subsequent infusible treatment.

Further, in the present invention, it is also advantageous to employ a method wherein tows of pitch fibers gathered in the presence of the oiling agent is introduced in a liquid spread to form a laminar flow so that fiber monofilaments constituting the tows will be aligned in the liquid.

When the tows of pitch fibers are introduced into the liquid spread to form a laminar flow, the liquid is permitted to flow countercurrently or parallelly, preferably countercurrently, relative to the direction of the transportation of the tows of pitch fibers. In such a case, the withdrawing speed of the tows of pitch fibers is properly selected within a range of from 1 to 100 m/min. depending upon the viscosity of the liquid so that the liquid spread to form a laminar flow will not form a turbulent flow.

In the present invention, the spreading of the liquid to form a laminar flow is meant that when the tows of pitch fibers are transported in the liquid, the liquid is permitted to flow at a flow rate and a flow rate distribution such that n disturbance or tangling of the fiber tows or no breakage of fiber filaments takes place due to an excessive flow of the liquid or due to the turbulence of the flow in the up-and-down directions. For this purpose, the flow rate of the liquid is not higher than 60 m/min., preferably from 0.1 to 50 m/min., and the flowing liquid depth is as shallow as from 1 to 50 mm, preferably from 2 to 40 mm.

Further, guide rollers or cascades may be provided to such a treating apparatus so that the fiber tows are subjected to alignment treatment by means of such jigs. In such a case, the treating apparatus is preferably designed so that the introduction portion for the tows of pitch fibers is wide and the withdrawing portion is narrow. In the present invention, it is a primary object to align the fiber monofilaments constituting the tows of pitch fibers. However, it is preferred to combine such an aligning treatment with a doubling treatment to form a bundle of fiber tows by doubling a plurality of fiber tows.

In such a case, all of the respective tows of pitch fibers are aligned in the liquid of a laminar flow and gathered to complete the doubling treatment, or the doubling treatment will be completed immediately after the respective tows are withdrawn from the liquid.

There is no particular restriction as to the shape of the treating apparatus. For instance, a tubular form apparatus or a flat plate form apparatus may be employed, or in a treating apparatus of such a shape, the flow passage of the liquid may be divided by partitions. It is preferred to employ an apparatus in which a certain angle is provided in the direction of the transportation of the fiber tows.

Figure 4:
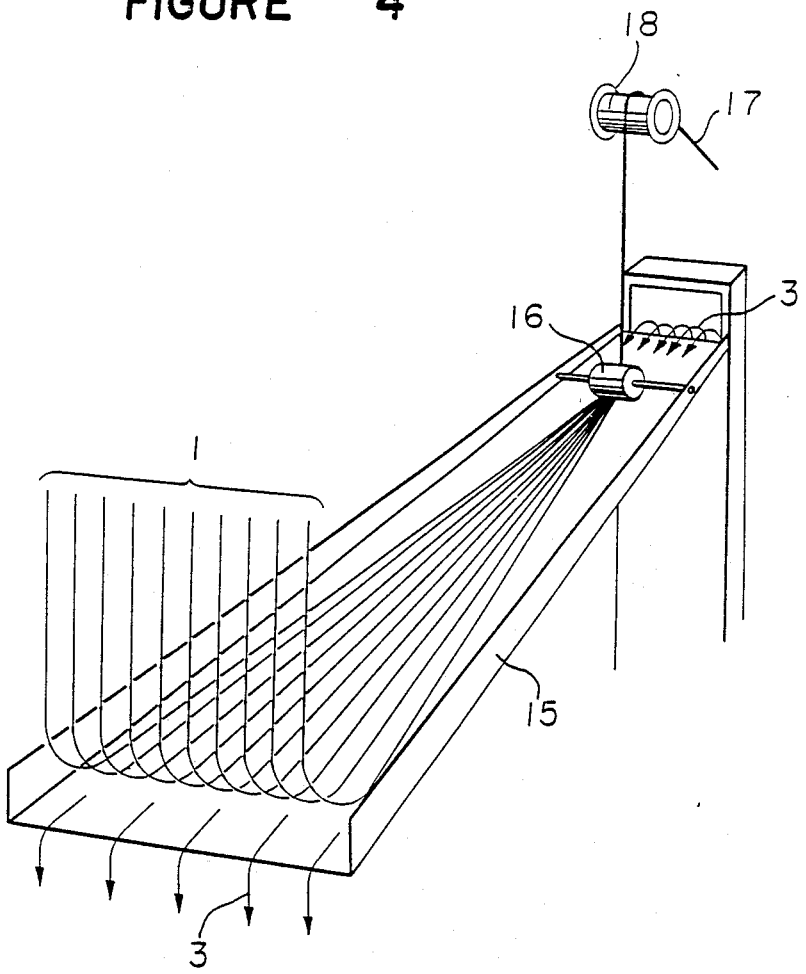

For example, as shown in FIG. 4, with a treating apparatus 15 of an inclined fan-shaped trough, a washing liquid 3 is permitted to flow down from the upstream so that the liquid is spread to form a laminar flow on the treating apparatus 15.

Then, from the down-stream of the treating apparatus 15, a plurality of tows 1 of pitch fibers are introduced into the liquid 3, then, the tows 1 of pitch fibers are transported countercurrently relative to the flow of the liquid 3. The respective tows of pitch fibers are gathered by a guide roller 16 to form a bundle of fiber tows, and then withdrawn.

If necessary, a twisted fiber tow may be formed by conducting the withdrawing operation by means of a twisting machine when the respective fiber tows are gathered.

Further, when the fiber tows 1 are introduced into the liquid 3, the tensile force exerted to the fiber tows 1 is substantially eliminated or reduced, the fiber tows 1 are fibrillated into the individual fibers constituting the tow, and during the introduction, a flexural force is applied to the fiber tows 1, the thick non-stretched fibers contained during the melt spinning will be removed, whereby the handling of the fiber tows 1 will be easy in the subsequent step.

There is no particular restriction as to the number of fiber tow to be treated by the present invention. However, when doubling treatment is conducted, the number of tows will be selected properly so that a desired doubled fiber tow will be obtained.

The fiber tows to be employed in the present invention are preferably tows of pitch fibers or infusibly treated fibers. Preferably, tows of pitch fibers are suitable.

Now, a method for removing non-stretched fibers contained in the tow of pitch fibers by fibrillizing the tow into fiber monofilaments constituting the tow, in the liquid when the tow of pitch fibers is brought in contact with the washing liquid, will be described.

The fibrillation treatment in the washing liquid is preferably applied to the tow of pitch fibers to which the oiling agent is applied, prior to the infusible treatment. However, if necessary, such fibrillation treatment may be applied to the tow of fibers subjected to infusible treatment prior to the carbonization.

In the present invention, the fibrillation treatment of the fiber tow in the liquid is a treatment in which the tensile strength exerted to the fiber tow during the transportation in the gaseous phase is eliminated or reduced so that no substantial tensile force is exerted to the fiber monofilaments constituting the tow and at least the width of the tow may be expanded. Specifically, as shown in FIG. 5, a fiber tow 1 is introduced into a liquid 3 by a guide bar or roller 19 provided in the gaseous phase of a treating tank, and fibrillation treatment is conducted during the passage of the fiber tow 1 in the liquid 3, and then the fiber tow is withdrawn by a withdrawing bar or roller 20 separately provided in the gaseous phase of the treating tank 2. Reference numeral 21 is a wind-up roller. Namely, in the present invention, it is important that the fiber tow is fibrillated in the liquid into the individual fiber monofilaments and forms a strip shape with an expanded width, whereby it can be always made in a gathered state when it is brought in contact with a bar or roller in the gaseous phase. Therefore, it is possible to fibrillate the brittle fibers without damaging them and remove the non-stretched fibers 20.

Further, the removal of non-stretched fibers 20 can more effectively be conducted by supplying the liquid in a flowing state to the treating tank 2, for instance, from a liquid jetting spout 22, in a direction opposite to the direction of the transportation of the fiber tow so that it is brought in contact countercurrently with the fiber tow 1 at a flow rate not to damage the fiber monofilaments, whereby the fiber tow 1 will spread in a tape shape on the liquid surface with a width of from 2 to 10 times the width in a gathered state. In such a case, if the flow rate of the liquid is excessive, the monofilaments are likely to break. Therefore, the flow rate of the liquid surface is preferably at a level of not higher than 60 m/min., preferably not higher than 50 m/min. Further, as a method for creating the flowing state of the liquid, it is effective to create the up-and-down current by gentle stirring or by means of supersonic waves or by blowing a gas. Reference numeral 23 is a water outlet.

The pitch fibers or infusibly-treated fibers after the fibrillation treatment as mentioned above will be subjected to infusible treatment and carbonization treatment or to carbonization treatment in accordance with well known methods.

In the process of the present invention, when the tow of pitch fibers after the washing step is to be stored for a while before subjecting it to infusible treatment, the tow of pitch fibers in a wet state is rapidly dried so that the amount of the deposited liquid will be not higher than 5% by weight, and then stored. The tow of pitch fibers after completion of the washing treatment usually contains the washing liquid in an amount of from 10 to 200% by weight relative to the fibers.

The wet condition in the present invention is meant for the condition wherein the surface of fiber monofilaments constituting the tow of pitch fibers are adequately wetted with the washing liquid, i.e. the wet state after forming the tow of pitch fibers in the presence of an oiling agent, or a wet state after subjecting the tow of pitch fibers to washing treatment by the washing step.

In the present invention, it is necessary to rapidly dry the tow of pitch fibers in the wet condition. For example, when the liquid to be dried is water, the tow of fibers is maintained at a temperature of 150° C. for from 30 minutes to 4 hours to bring the amount of the deposited liquid to a level of not higher than 5% by weight, preferably not higher than 4% by weight. Here, it is important that the tow of pitch fibers in a wet state is rapidly dried prior to the storage. Although the cause is not well understood, when the tow is left in the wet condition for a period of 6 hours or more, and then the deposited liquid is gradually evaporated, the desired effects of the present invention can not be obtained. Therefore, the time until the initiation of the drying should be within 6 hours, preferably within 5 hours, although it may vary depending upon the conditions of the surrounding atmosphere. The drying is conducted at a temperature higher than the boiling point of the liquid deposited on the pitch fibers in the wet condition, preferably at a temperature higher by from 10° to 100° C. than the boiling point, more preferably at a temperature higher by from 20° to 80° C. than the boiling point until the amount of the liquid deposited on the pitch fibers becomes not more than 5% by weight, preferably not more than 4% by weight. Further, depending upon the type of the liquid, the drying can be conducted at a temperature lower than the boiling point of the liquid by drying under reduced pressure or drying under air stream. The drying time varies depending upon the type and the deposited amount of the liquid, but is usually not longer than 5 hours, preferably not longer than 4 hours.

The pitch fibers treated by the washing treatment of the present invention are then subjected to fusing treatment and carbonization treatment in accordance with well known methods. For instance, the infusible treatment may be conducted by heating the fibers at a temperature of from 150° to 360° C. for from 5 minutes to 10 hours in an oxidizing atmosphere such as oxygen, ozone, air, nitrogen oxide, a halogen or sulfur dioxide gas. The carbonization treatment may be conducted by heating the fibers at a temperature of from 400° to 1,600° C. for from 0.5 minute to 10 hours in an inert gas atmosphere such as nitrogen or argon.

Further, the graphitization treatment may be conducted by heating the fibers at a temperature of from 1,600° to 3,500° C. for from 1 second to 1 hour.

If necessary, a load or tension may be applied to the tow of pitch fibers to some extent during the infusible treatment, the carbonization treatment or the graphitization treatment for the purpose of preventing shrinkage or deformation.

Further, for the infusible treatment, it is desirable to preliminarily maintain the pitch fibers at a temperature of from 50° to 100° C. for from 5 minutes to 2 hours to dry the washing liquid deposited on the pitch fibers by providing a dryer immediately before the infusible treatment furnace, or in the initial zone in the infusible treatment furnace.

Now, the present invention will be described in further detail with reference to Examples. However, it should be understood that the present invention is by no means restricted to such specific Examples.

EXAMPLES 1 to 3

Coal tar-originated pitch material for spinning is melt-spun at a spinneret temperature of 330° C. Then, an oiling agent as identified in Table 1 was applied to a tow of pitch fibers comprising 1,000 filaments with a diameter of 10 μm, thus obtained (the amount of deposition: about 30% by weight). Then, the tow of gathered pitch fibers was passed through a washing liquid at room temperature by using an apparatus having a structure as shown in FIG. 1, and then dried by maintaining it at 120° C. for 30 minutes in air. Then, it was heated from 150° C. to 350° C. over a period of 2 hours and 40 minutes, and maintained at that temperature for further 30 minutes to conduct infusible treatment. Thereafter, it was heated in argon from room temperature to 1,400° C. over a period of 2 hours and 20 minutes and maintained at that temperature for 1 hour to conduct carbonization treatment, whereby carbon fibers were obtained. The state of the fibers after the infusible treatment and the state of fusion of monofilaments were observed, and the tensile strength of the carbon fibers was measured. The results are shown in Table 1.

COMPARATIVE EXAMPLES 1 and 2

The operations were conducted in the same manner as in Examples 1 to 3 except that no washing step was included. The results are also shown in Table 1.

TABLE 1

| | Oiling agent Type | Emulsion concentration (% by weight) | Washing liquid Type | Fibers after infusible Treatment State | Fibers after infusible Treatment Fusion of monofilaments | Carbon fibers Tensile strength (kg/mm²) |
|---|---|---|---|---|---|---|
| Example 1 | Dimethylsilicone | 2 | water | Soft | No | 302 |
| Example 2 | " | 6 | water | " | No | 313 |
| Example 3 | " | 6 | Ethanol | " | No | 298 |
| Comparative Example 1 | " | 2 | — | Hard | Yes | 245 |
| Comparative Example 1 | " | 6 | — | " | Yes | 233 |

EXAMPLE 4

Coal tar-originated pitch material for spinning was melt-spun with a spinneret temperature of 330° C. by using a spinneret having 1,000 nozzle holes. Then, an aqueous emulsion of a silicone oil was applied to pitch fibers having a diameter of 10 μm thus obtained and the pitch fibers were gathered. The tows of gathered pitch fibers were aligned and doubled by means of an apparatus as shown in FIG. 3. Namely, ten fiber tows 1,1′,1″ . . . were pulled up by the roller 6 and gathered, and introduced together with an adequate water stream supplied from the conduit 7 into the treating tank 2 filled with water in a direction vertical to the water surface at a rate of 8 m/min. and manipulated to turn at a location 30 cm below the liquid surface to the direction opposite to the direction of introduction. Then, the fiber tow was withdrawn at a rate of 8 m/min. by the roller 14 provided in the gaseous phase outside the treating tank while being contacted with a water stream supplied from the conduit 12 and flowing countercurrently against the direction of transportation of the fiber tows supplied. The doubled fiber tows (ten tows each comprising 1,000 monofilamens) were then held and dried in air at 150° C. for 30 minutes, and further heated from 150° C. to 300° C. over a period of 2 hours and 30 minutes, and thereafter maintained at that temperature for 30 minutes to conduct infusible treatment. Then, they were heated in argon from room temperature to 1,400° C. over a period of 2 hours and 20 minutes, and then maintained at that temperature for 1 hour to conduct carbonization treatment, whereby carbon fibers were obtained. The carbon fibers thus obtained were free from breakage or fluffing and had excellent alignment of fiber filaments and good flexibility.

EXAMPLE 5

Coal tar-originated pitch material for spinning was melt-spun at a spinning temperature of 330° C. by using a spinneret having 1,000 nozzle holes. Then, an aqueous emulsion of a silicone oil was applied to the pitch fibers having a diameter of 10 μm thus obtained, and the pitch fibers were gathered. The tows of gathered pitch fibers were aligned and doubled by using the apparatus as shown in FIG. 4. Specifically, water as the liquid 3 from the top (the up-stream) of the treating apparatus of an inclined fun-shaped trough was spread to form a laminar flow in a depth of 5 mm with a flow rate of 10 m/min. Then, from the down-stream of the treating apparatus 15, ten tows 1 of pitch fibers were introduced, and while aligning fiber monofilaments constituting the tows 1 in the shallow water in the treating apparatus 15, doubling treatment was conducted to form a single tow of fibers composed of 10,000 fiber monofilaments. The doubled fiber tow 17 was withdrawn by means of the guide roller 16 and the driving roller 18 from the treating apparatus 2 at a rate of 8 m/min. Then, it was held and dried in air at 150° C. for 30 minutes, and further heated from 150° C. to 300° C. over a period of 2 hours and 30 minutes, and then held at that temperature for 30 minutes to conduct infusible treatment. Thereafter, it was heated in argon from room temperature to 1,400° C. over a period of 2 hours and 20 minutes, and then held at that temperature for 1 hour to conduct carbonization treatment, whereby carbon fibers were obtained. The carbon fibers thus obtained were free from loose or fluffy fibers, and had excellent alignment of fibers and good flexibility.

EXAMPLES 6 and 7

Coal tar-originated pitch material for spinning was melt-spun at a spinneret temperature of 330° C. by using a spinneret having 1,000 nozzle holes. Then, an aqueous emulsion of a silicone oil was applied to the pitch fibers having a diameter of 10 μm thus obtained, and the pitch fibers were gathered.

The tow of gathered pitch fibers was subjected to fibrillation treatment by means of the apparatus as shown in FIG. 5 by using water as the liquid and water was not permitted to flow. In the treating tank 2, the tow of pitch fibers was fibrillated into fiber monofilaments, whereby non-stretched fibers were separated and sedimented at the bottom of the treating tank 2.

The number of the removed non-stretched fibers and the number of not-removed non-stretched fibers were measured per 10,000 m of the fibers after the tow 3 of pitch fibers was passed through the treating tank 2 (length: 1.5 m) at a rate of 8 m/min. The results are shown in Table 2. Further, a water jet spout 22 was provided at a position 10 mm below the water surface in the treating apparatus 2, and water was jetted at a flow rate as shown in Table 2 to form a water stream flowing countercurrently with respect to the tow 1 of pitch fibers, and the fibrillation treatment was conducted in the same manner.

The results are also shown in Table 2.

Then, the tow 1 of pitch fibers passed through the treating tank 2 for the fibrillation treatment, was held and dried in air at 150° C. for 30 minutes, and then heated from 150° C. to 300° C. over a period of 2 hours and 30 minutes, and then held at that temperature for 30 minutes to conduct infusible treatment. Thereafter, it was heated in argon from room temperature to 1,400° C. over a period of 2 hours and 20 minutes, and then held at that temperature for 1 hour to conduct carbonization treatment, whereby pitch-type carbon fibers were obtained. With respect to the carbon fibers thus obtained, formed or fused portions were investigated. The results are shown in Table 2.

COMPARATIVE EXAMPLE 3

In Examples 6 and 7, the tow of pitch fibers gathered without passing the treating tank for the infusible treatment in a liquid, was subjected to infusible treatment and carbonization treatment in the same manner as in Examples 6 and 7. The carbon fibers thus obtained had portions where the fibers were fused one another by foaming. The number of such foamed and fused portions is shown in Table 2.

TABLE 2

| | Liquid flow rate (m/min) | Separation of non-stretched fibers (1000 filaments, 20,000 m) Number of removed fibers | Number of not removed fibers | Separation rate (%) | Foamed and fused portions in the carbon fibers |
|---|---|---|---|---|---|
| Example 6 | 0 | 81 | 12 | 87 | 5 |
| Example 7 | 10 | 103 | 0 | 100 | 0 |
| Comparative Example 3 | — | — | — | 0 | 58 |

EXAMPLE 8

Coal tar-originated pitch material for spinning was melt-spun at a spinning temperature of 330° C. by using a spinneret having 500 nozzle holes. Then, an aqueous emulsion of a silicone oil having a concentration of 6% was applied as an oiling agent to the pitch fibers having a diameter of 10 μm thus obtained in an amount of 30% by weight relative to the pitch fibers, and the pitch fibers were then gathered. The water content of the tow of pitch fibers thus obtained was 28.2% by weight, and the amount of the oiling agent deposited was 1.8% by weight. The tow of pitch fibers was then dried at 150° C. for 1 hour, and stored at room temperature for 7 days. At that time, the amount of water deposited on the tow of pitch fibers was not more than 0.2% by weight, and no deposition of the oiling agent was observed. Then, it was heated to 300° C. over a period of 2 hours and 30 minutes, and then held for 30 minutes to conduct infusible treatment. The tow of fibers after the infusible treatment was then cut into a length of 5 cm, and the tensile test was conducted to measure the strength of the fiber tow. The results are shown in Table 3.

EXAMPLE 9

The spinning was conducted in the same manner as in Example 8, and 12 tows of gathered pitch fibers were doubled while being washed in water, to obtain a tow of pitch fibers comprising 6,000 monofilaments. The tow of pitch fibers thus obtained was in a wet condition with the amount of the deposited liquid being 150% by weight relative to the pitch fibers (the deposited oiling agent proper: not more than 0.1% by weight). Then, it was rapidly dried at 150° C. for 1 hour, and stored at room temperature for 7 days. At that time, the amount of the liquid deposited on the tows of pitch fibers was not more than 0.2% by weight, and no deposition of the oiling agent was observed.

Then, infusible treatment was conducted in the same manner as in Example 8. Thereafter, it was heated in argon from room temperature to 1,400° C. over a period of 2 hours and 20 minutes, and then held at that temperature for 1 hour to conduct carbonization treatment.

whereby pitch-type carbon fibers are obtained. The carbon fibers thus obtained was subjected to a tensile test to measure the strength. The results are shown in Table 4.

COMPARATIVE EXAMPLE 4

The tow of pitch fibers obtained in the same manner as in Example 8 was stored at room temperature in a open state for 7 days without subjecting the tow of pitch fibers to rapid drying treatment. At that time, the amount of water deposited on the tow of pitch fibers was not higher than 0.2% by weight. But the amount of the oiling agent deposited did not change at a level of 1.8% by weight. The tow of pitch fibers was subjected to infusible treatment in the same manner as in Example 8, and then subjected to the same test. The results are shown in Table 3.

COMPARATIVE EXAMPLE 5

A tow of pitch fibers obtained in the same manner as in Example 9 was stored at room temperature in an open state for 7 days without subjecting the tow of pitch fibers to the rapid drying. At that time, the amount of water deposited on the tow of pitch fibers was not more than 0.2% by weight, but the amount of the oiling agent deposited did not change at a level of not more than 0.1% by weight.

The tow of pitch fibers was subjected to infusible treatment and carbonization treatment in the same manner as in Example 9, whereby pitch fiber-type carbon fibers were obtained. The tensile strength of the carbon fibers was measured. The results are shown in Table 4.

In these Examples and Comparative Examples, the results of the tensile tests are average values with respect to 30 samples of the respective tows of fibers. Further, the fluctuation coefficient is a value obtained by dividing the standard deviation with respect to 30 samples by the average value.

TABLE 3

| | Rapid drying (150° C./hr.) | Stored days | Strength of fibers after infusible treatment: Strength* (g) | Strength of fibers after infusible treatment: Deviation coefficient |
|---|---|---|---|---|
| Example 8 | Yes | 7 | 58 | 9 |
| Comparative Example 4 | No | 7 | 12 | 38 |

Note: *The maximum load until the tow of fibers breaks when both ends of the fiber tow of 500 filaments are pulled apart.

TABLE 4

| | Rapid drying (150° C./hr.) | Stored days | Amount of water deposited (ppm)** | State of fibers after infusible treatment | Strength of carbon monofilaments: Tensile strength (kg/mm$^2$) | Strength of carbon monofilaments: Deviation coefficient (%) |
|---|---|---|---|---|---|---|
| Example 9 | Yes | 7 | 1,100 | Flexible | 303 | 13 |
| Comparative Example 5 | No | 7 | 1,800 | Brittle | 270 | 27 |

Note: **Prior to the initiation of infusible treatment

As described in detail in the foregoing, according to the present invention, after melt-spinning pitch material, an oiling agent is applied to the pitch fibers, and a plurality of brittle pitch fibers are gathered to form a tow of pitch fibers so that the handling can thereby be easy, then an excess oiling agent is washed and removed prior to the infusible treatment, whereby no adhesion or fusion of the fiber filaments takes place during the subsequent infusible treatment or carbonization treatment, and pitch-type carbon fibers having excellent properties and high quality can be produced in the form of continuous filaments under an industrially advantageous condition.

Further, in the present invention, by a simple operation of passing a tow of pitch fibers in a liquid in a certain specific manner, the tow of pitch fibers can be fibrillated in the liquid into individual monofilaments, whereby uniform tension is exerted to the fibers when they are withdrawn, whereby brittle pitch fibers can be well aligned with a small tension, and the gathering property of the tow of fibers withdrawn is excellent. Further, as a step of doubling fibers, it is possible to conduct the aligning treatment of the present invention during the doubling treatment. Further, the doubling is conducted at the stage of pitch fibers, the subsequent infusible treatment and carbonization treatment can be conducted in a bundled state of doubled fibers, whereby pitch-type carbon fibers having a high quality can be produced constantly in the form of continuous filaments.

Furthermore, in the present invention, by a very simple operation of passing a plurality of tows of pitch fibers in a liquid spread to form a laminar flow, the tows of fibers are fibrillated into individual fiber filaments constituting the tows in the liquid, whereby a uniform tension is exerted to the monofilaments so that brittle fiber tows can be efficiently alingned and doubled with a small tension, and the handling of fibers in the subsequent step will be excellent, or the bundling properties of the doubled fiber tows will be excellent. Further, when the doubling treatment was conducted at the stage of pitch fibers, the subsequent infusible treatment and carbonization treatment can be conducted in a bundled state of doubled fibers, and the productivity can be improved and pitch-type carbon fibers having a high quality can be produced constantly in the form of continuous filaments.

Moreover, according to the present invention, by a simple operation of subjecting the tow of gathered pitch fibers to fibrillating treatment in a liquid, it is possible to remove non-stretched fibers without damaging the brittle pitch fibers, whereby partial or local fusion during the carbonization treatment will be prevented, and pitch-type carbon fibers of a high quality can be produced constantly in the form of continuous filaments.

Further, according to the process of the present invention, the tow of pitch fibers in a wet condition is rapidly dried and then stored for several days, whereby there will be no phenomenon for the change of the fiber condition with time, and the tow of pitch fibers after drying is in a plump state, and it is possible to obtain pitch-type carbon fibers having uniform quality and flexible after the infusible treatment and carbonization treatment. Further, the heating and drying at a temperature higher than the boiling point of the deposited liquid serves as a pretreatment before the infusible treatment, whereby it is possible to prevent the overrun due to the heat generation at the time of the infusible treatment. Further, there are additional advantages such as an increase of fillers and shortening of the temperature raising time.

We claim:

1. A process for producing pitch-based carbon fibers, which comprises:

(a) melt-spinning pitch material in a gaseous atmosphere to form pitch fibers;

(b) gathering the pitch fibers into a tow either before or after applying to the fibers an oiling agent consisting essentially of:

(i) a silicone oil selected from the group consisting of dimethylpolysiloxane, phenylmethylpolysiloxane, epoxypolysiloxane and aminopolysiloxane;

(ii) a higher alcohol selected from the group consisting of stearyl alcohol, oleyl alcohol and isopentacosanyl alcohol; and (iii) a higher fatty acid selected from the group consisting of stearic acid glyceride, polyethyleneglycol and stearate and polyethylene glycol oleate, and mixtures and emulsions of all of the above;

(c) washing said gathered fibers with a solvent incapable of substantially dissolving said fibers, but capable of removing the oiling agent deposited on said fibers, thereby removing said oiling agent;

(d) subjecting said washed fibers to an infusible treatment by heating the fibers for a time and a temperature sufficient to effect the same; and (e) carbonizing the fibers by heating the fibers in inert atmosphere for a time and at a temperature sufficient to carbonize the same.

2. The process according to claim 1, wherein the contact of the tow of pitch fibers with the washing liquid is conducted by passing the tow of pitch fibers continuously through the washing liquid.

3. The process according to claim 1, wherein the contact of the tow of pitch fibers with the washing liquid is conducted by introducing the tow into the washing liquid in a direction substantially vertical to the surface of the liquid, then turning it in the liquid to a direction substantially opposite to the direction of the introduction, and withdrawing it from the liquid in the substantially opposite direction.

4. The process according to claim 1, wherein the contact of the tow of pitch fibers with the washing liquid is conducted by introducing the tow into the washing liquid spread to form a laminar flow, and then withdrawing it from the liquid.

5. The process according to claim 1, wherein the tow of pitch fibers is fibrillated in the liquid into pitch fiber monofilaments constituting the tow so that non-stretched pitch fiber monofilaments contained in the tow are removed.

6. The process according to claim 1, wherein the tow of pitch fibers is obtained by doubling a plurality of pitch fiber tows.

7. The process according to claim 1, wherein the washing liquid is an organic solvent substantially incapable of dissolving pitch fibers, water or a mixture thereof.

8. The process according to claim 7, wherein the organic solvent is an aliphatic alcohol having from 1 to 4 carbon atoms, an alicyclic alcohol having from 3 to 6 carbon atoms, or a ketone having from 3 to 6 carbon atoms.

9. The process according to claim 1, wherein the oiling agent is a silicone oil or an aqueous emulsion of a silicone oil.

10. The process according to claim 1, wherein the oiling agent is applied in an amount of at least 0.1 part by weight, as the oiling agent proper, excluding its diluent, relative to 100 parts by weight of the pitch fibers.

11. The process according to claim 1, wherein the tow of pitch fibers is withdrawn from the washing liquid while contacting the tow with the liquid flowing countercurrently relative to the direction of the transportation of the tow.

12. The process according to claim 4, wherein a plurality of pitch fiber tows are simultaneously introduced in the washing liquid spread to form a laminar flow, then doubled, and withdrawn from the liquid.

13. The process according to claim 5, wherein the fibrillation is conducted under such condition that substantially no tensile force is exerted to the monofilaments constituting the tow of fibers.

14. The process according to claim 1, wherein the washing liquid is flowing.

15. The process according to claim 1, wherein the tow of pitch fibers in a wet condition after the contact with the washing liquid, is rapidly dried so that the amount of the deposited liquid is not more than 5% by weight, then stored and subsequently subjected to the infusible treatment.

16. The process according to claim 15, wherein the drying is conducted for a period of not longer than 5 hours.

17. The process according to claim 15, wherein the amount of the deposited liquid after drying is not more than 4% by weight.

18. The process according to claim 15, wherein the tow of pitch fibers in the wet condition contains the liquid in an amount of from 10 to 200% by weight.

19. The process according to claim 1, which further comprises graphitizing the fibers after carbonizing the same.

20. The process according to claim 1, wherein said melt-spinning is effected by extruding molten pitch material into a gaseous atmosphere from spinning nozzles, said nozzles having a temperature of from about 250–350° C.

21. The process according to claim 1, wherein said oiling agent further contains an emulsifying agent or an antistatic agent or both.

22. The process according to claim 21, wherein said emulsifying agent is a nonionic emulsifier, an anionic emulsified or a cationic emulsifier.

23. The process according to claim 21, wherein said antistatic agent is an anionic, cationic or amphoteric antistatic agent.

24. The process according to claim 10, wherein said oiling agent is used in an amount of 0.1 to 100 parts by weight relative to the weight of the pitch fibers.

25. The process according to claim 8, wherein said organic solvent is selected from the group consisting of methanol, ethanol, propanol, butanol, isopropanol, ethylene glycol, cellosolve, cyclopentanol, cyclohexanol, acetone, methyl ethyl ketone, methyl isobutyl ketone, and cyclohexane and mixtures thereof.

26. The process according to claim 1, wherein said infusible treatment is effected by heating the fibers at a temperature of from about 150° to 360° C. for from about 5 minutes to 10 hours in an oxidizing atmosphere.

27. The process according to claim 26, wherein said oxidizing atmosphere is oxygen, ozone, air, nitrogen oxide, a halogen gas or sulfur dioxide.

28. The process according to claim 1, wherein said carbonization is effected by heating the fibers at a temperature of from about 400° to 1,600° C. for from about 0.5 minutes to 10 hours in an inert gas atmosphere.

29. The process according to claim 28, wherein said inert gas is nitrogen or argon.

30. The process according to claim 19, wherein said graphitization is effected by heating the fibers at a temperature of from about 1,600° to 3,500° C. for from about 1 second to 1 hour.

31. The process according to claim 26, which further comprises preliminarily heating the fibers at a temperature of from about 50° to 100° C. for from about 5 minutes to 2 hours, thereby drying the washing liquid on the fibers.

* * * * *

UNITED STATES PATENT AND TRADEMARK OFFICE

CERTIFICATE OF CORRECTION

PATENT NO. : 4,923,692

DATED : May 8, 1990

INVENTOR(S) : Akira Nakagoshi, et al

It is certified that error appears in the above-identified patent and that said Letters Patent is hereby corrected as shown below:

On the title page:

The Filing Date is incorrect, it should read

--September 28, 1988--

Signed and Sealed this

Eleventh Day of June, 1991

*Attest:*

HARRY F. MANBECK, JR.

*Attesting Officer*

*Commissioner of Patents and Trademarks*